US011932295B2

(12) United States Patent
Hanczor et al.

(10) Patent No.: US 11,932,295 B2
(45) Date of Patent: Mar. 19, 2024

(54) ENHANCED TRANSIT LOCATION SYSTEMS AND METHODS

(71) Applicant: Piper Networks, Inc., San Diego, CA (US)

(72) Inventors: Robert Hanczor, San Diego, CA (US); Duane Maxwell, San Diego, CA (US)

(73) Assignee: Piper Networks, Inc., San Diego, CA (US)

( * ) Notice: Subject to any disclaimer, the term of this patent is extended or adjusted under 35 U.S.C. 154(b) by 0 days.

(21) Appl. No.: 18/131,076

(22) Filed: Apr. 5, 2023

(65) Prior Publication Data

US 2023/0249725 A1 Aug. 10, 2023

Related U.S. Application Data

(63) Continuation of application No. 17/008,450, filed on Aug. 31, 2020, now Pat. No. 11,697,444.

(60) Provisional application No. 62/893,724, filed on Aug. 29, 2019.

(51) Int. Cl.
*B61L 25/04* (2006.01)
*B61L 25/02* (2006.01)

(52) U.S. Cl.
CPC ..... *B61L 25/04* (2013.01); *B61L 25/025* (2013.01); *B61L 25/028* (2013.01)

(58) Field of Classification Search
CPC ..... B61L 25/04; B61L 25/025; B61L 25/028
See application file for complete search history.

(56) References Cited

U.S. PATENT DOCUMENTS

| | | | |
|---|---|---|---|
| 4,711,418 | A | 12/1987 | Aver, Jr. et al. |
| 5,420,883 | A | 5/1995 | Swenson et al. |
| 6,900,740 | B2 | 5/2005 | Bloomquist et al. |
| 8,655,372 | B2 | 2/2014 | Riesco |

(Continued)

FOREIGN PATENT DOCUMENTS

| | | | |
|---|---|---|---|
| CN | 108639109 | A | 10/2018 |
| WO | 2018/108180 | A1 | 6/2018 |

OTHER PUBLICATIONS

International Search Report and Written Opinion in PCT/US2020/048839, dated Nov. 30, 2020.

(Continued)

*Primary Examiner* — Mathew Franklin Gordon
(74) *Attorney, Agent, or Firm* — Sheppard Mullin Richter & Hampton LLP

(57) ABSTRACT

A computer-implemented method comprises: receiving, at a first one of the first electronic devices, a first wireless signal transmitted by a second electronic device attached to a vehicle; transmitting, from the first electronic device, a second wireless signal, wherein the second electronic device determines a location of the vehicle along the transportation pathway according to the second wireless signal; receiving, at the first electronic device, a third wireless signal transmitted by a second electronic device, wherein the third wireless signal identifies the determined location of the vehicle; and transmitting, from the first electronic device, a fourth wireless signal, wherein the fourth wireless signal identifies the determined location of the vehicle, wherein other ones of the first electronic devices wirelessly relay fifth wireless signals along the transportation pathway, wherein the fifth wireless signals identify the determined location of the vehicle.

20 Claims, 13 Drawing Sheets
(11 of 13 Drawing Sheet(s) Filed in Color)

(56) References Cited

U.S. PATENT DOCUMENTS

| | | | |
|---|---|---|---|
| 9,470,531 | B2 | 10/2016 | Moerman |
| 2005/0174974 | A1 | 8/2005 | Sonnitag et al. |
| 2012/0283947 | A1 | 11/2012 | T'Siobbel |
| 2013/0127643 | A1 | 5/2013 | Malarky |
| 2014/0210595 | A1 | 7/2014 | Kanner et al. |
| 2015/0329130 | A1 | 11/2015 | Carlson et al. |
| 2016/0121912 | A1 | 5/2016 | Puttagunta et al. |
| 2016/0280240 | A1 | 9/2016 | Carlson et al. |
| 2018/0188380 | A1 | 7/2018 | Venkatraman et al. |
| 2019/0090117 | A1 | 3/2019 | Shirahatti et al. |
| 2019/0113631 | A1 | 4/2019 | Stroiescu et al. |
| 2019/0332120 | A1 | 10/2019 | Choi |
| 2020/0070859 | A1 | 3/2020 | Green |
| 2020/0189633 | A1 | 6/2020 | Green |
| 2020/0309533 | A1 | 10/2020 | Young et al. |
| 2021/0171079 | A1 | 4/2021 | Green |
| 2021/0354718 | A1 | 11/2021 | Lu |

OTHER PUBLICATIONS

"Electromagnetic compatibility and Radio spectrum Matters (ERM); Short Range Devices (SRD); UWB location tracking devices in the railroad environment", ETSI Technical Report, ETSI TR 101 358 V1.1.1 (Oct. 2012).

International Search Report and Written Opinion in PCT/US2020/049767, dated Dec. 9, 2020.

ENHANCED TRANSIT LOCATION SYSTEMS AND METHODS

CROSS REFERENCE TO RELATED APPLICATIONS

The present application is a continuation of U.S. patent application Ser. No. 17/008,450, filed Aug. 31, 2020, entitled "ENHANCED TRANSIT LOCATION SYSTEMS AND METHODS," which claims priority to U.S. Provisional Patent Application No. 62/893,724, filed Aug. 29, 2019, entitled "ENHANCED TRANSIT LOCATION SYSTEMS AND METHODS," the disclosure thereof is incorporated by reference herein in its entirety.

FIELD

The present disclosure relates generally to transportation intelligence, and more specifically to systems and methods for enhanced identification of transit location.

SUMMARY

Embodiments of the present disclosure provide systems and methods for tracking information relating to transportation vehicles. For example, some embodiments of the disclosure provide a system for enhanced location and data collection from vehicles traveling along a vehicle pathway. The system may include a communications mesh architecture of vehicle tagging devices and anchored transceivers affixed to segments of a vehicle pathway. For example, the vehicle may be a light rail train, a commuter train, a freight train, an automobile, an airplane, a ship, a space vehicle, a ski lift, a gondola, or other forms of transportation as known in the art. The transportation pathway may be any pathway along which the respective vehicle moves, such as a train track, a road, a canal or shipping lane, a runway, an airway, or other vehicle pathways as known in the art. By providing a communications mesh architecture, the enhanced transit location system may be fault tolerant while still providing highly accurate, real-time location data for vehicles.

The system may include a mesh network of anchored transceivers and vehicle tagging devices. Both the anchored transceivers and the vehicle tagging devices may incorporate impulse-radio ultra-wideband (IR-UWB) transceivers for both distance ranging and backhaul data transmission, together with the transmission of other attributes relevant to vehicle tracking, including vehicle speed, charge or fuel levels, warning flags, etc.

Vehicle tagging devices may mounted in the front and/or the back of vehicles, or vehicle segments (e.g., train cars). The vehicle tagging devices may obtain ranging data and distance information from anchored transceivers affixed along a vehicle pathway (e.g., a train track, train tunnel, road, etc.) As the vehicle moves along the vehicle pathway, the vehicle tagging devices may transmit a data beacon (e.g., a "ping") and anchored transceivers may respond with a corresponding anchor identification signal including a unique identifier for the respective anchor, together with a relative distance from the vehicle tagging device.

The vehicle tagging device on the vehicle may receive the anchor identification signal. The vehicle tagging device may also include a processor and a non-transitory computer readable memory with computer executable instructions embedded thereon, the computer executable instructions configured to cause the processor to compute real-time multilateration, The vehicle tagging device may inject the vehicles location (e.g., an x-y coordinate, x-y-z coordinate, track number and distance) into a backhaul. The backhaul may represent a chain of anchored transceivers proximately located to one another and extending along the vehicle pathway.

In some examples, the vehicle may be a subway train, the vehicle pathway may be the train track, train track substrate, or subway tunnel, and the backhaul may be the chain of anchored transceivers extending along the train track, train track substrate, or subway tunnel to a base station (e.g., a border anchored transceiver).

Anchored transceivers may include a processor and a non-transitory computer readable memory with computer executable instructions embedded thereon, the computer executable instructions configured to cause the processor to compute relative distance to an approaching vehicle tagging device.

The anchored transceiver may transmit the relative distance to of the vehicle tagging device, together with location data, through the backhaul to a bridge anchored transceiver. To enhance reliability, accuracy, and fault tolerance, anchored transceivers may be positioned in relatively close proximity to one another at regular intervals along the backhaul. In some examples, the anchored transceivers may be placed along girders along the walls of the tunnel spaced between 5 and 20 meters apart. These and other objects, features, and characteristics of the system and/or method disclosed herein, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

BRIEF DESCRIPTION OF THE DRAWINGS

The technology disclosed herein, in accordance with one or more various embodiments, is described in detail with reference to the following figures. The drawings are provided for purposes of illustration only and merely depict typical or example embodiments of the disclosed technology. These drawings are provided to facilitate the reader's understanding of the disclosed technology and shall not be considered limiting of the breadth, scope, or applicability thereof. It should be noted that for clarity and ease of illustration these drawings are not necessarily made to scale.

The patent or application file contains at least one drawing executed in color. Copies of this patent or patent application publication with color drawing(s) will be provided by the Office upon request and payment of the necessary fee.

Figure 1A:
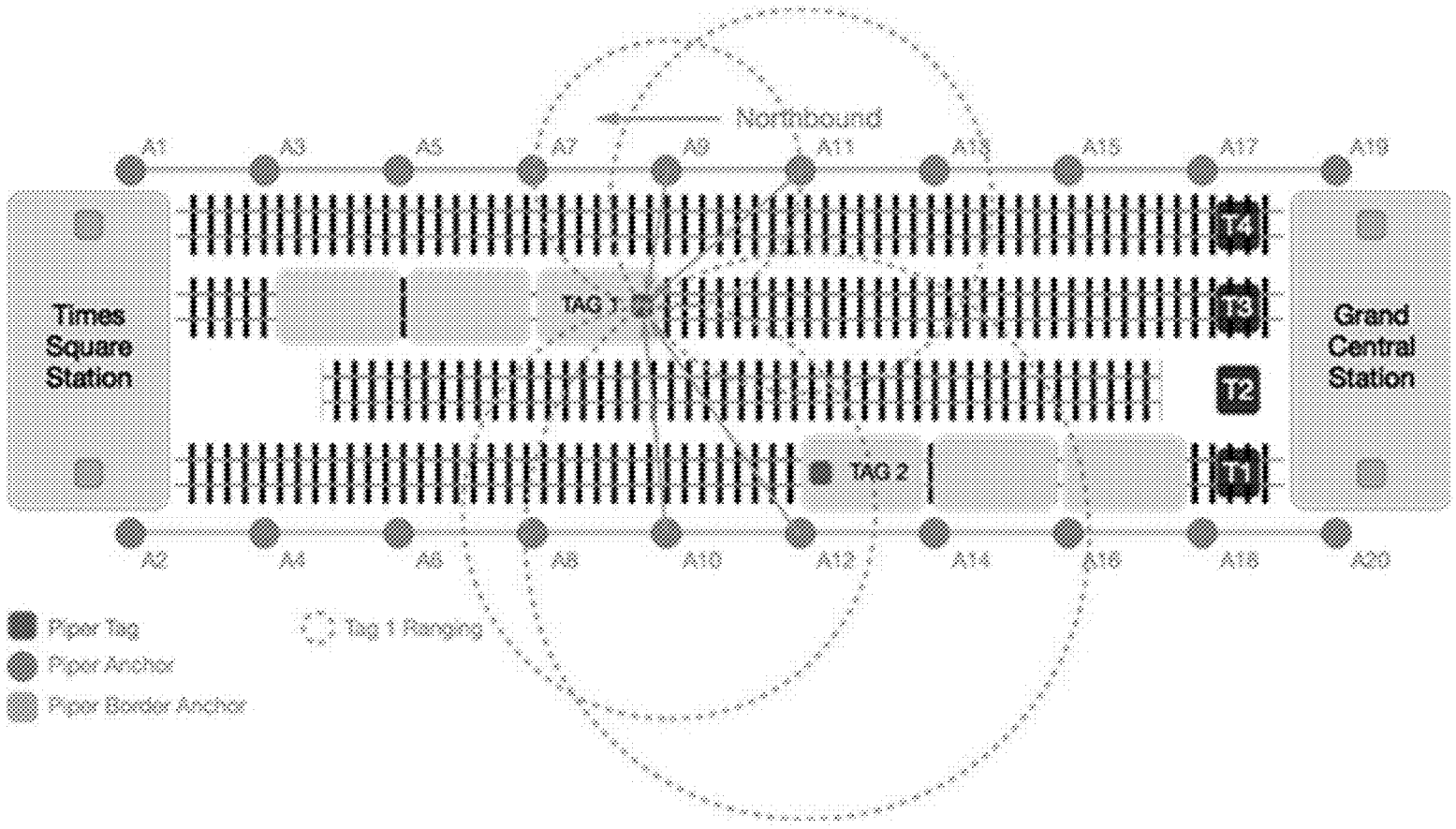
FIG. 1A illustrates an example system for enhanced location and data collection from vehicles traveling along a vehicle pathway, consistent with embodiments disclosed herein.

The figures are not intended to be exhaustive or to limit the invention to the precise form disclosed. It should be understood that the invention can be practiced with modification and alteration, and that the disclosed technology be limited only by the claims and the equivalents thereof.

DETAILED DESCRIPTION

Embodiments of the present disclosure provide systems and methods for enhanced location and data collection from vehicles traveling along a vehicle pathway. In some embodiments of the disclosure, a system for enhanced location and data collection includes a plurality of vehicle tagging devices and a plurality of anchored transceivers configured to communicate using a mesh network technology. For example, the vehicle tagging devices and anchored transceivers may include IR-UWB localization transceivers.

In some examples, the vehicle may be a train and the vehicle pathway may be a train track, train platform, or train tunnel, such as a subway tunnel system. The interaction between anchored transceivers mounted high on the girders in the tunnel and vehicle tagging devices installed on the trains may facilitate collection of the geolocation of a given train. As a train moves through the tunnel, time-of-arrival (TOA) and/or time-of-flight (TOF) may be measured between anchored transceivers and vehicle tagging devices. The vehicle tagging devices may include processors and non-transitory computer readable memory with computer executable instructions embedded thereon, the computer executable instructions configured to cause the processor to compute real-time multilateration to effectively triangulate the vehicle tagging device's location and inject the train's track position and distance from a previous train station into the backhaul. Vehicle tagging devices may include a data store or be communicatively coupled to a data store, e.g., using a wireless network. The data store may include location data for multiple anchored transceivers in the system. The vehicle tagging devices may be configured to identify and distinguish intersecting points on the track and intersecting points behind a wall in order to identify correct vehicle tagging device geolocation.

In some examples, interactions between stationary (e.g., anchor sensors mounted on stationary structures) and moving sensors (e.g., tag sensors mounted on moving vehicles) will produce sensor signals that can be processed by a distributed sensor network (e.g., comprising anchors and tags) for accurate positioning of vehicles with respect to stationary structures. The localization data generated by the distributed sensor network may be made available to a vehicle tracking system to track and display relative positions and other characteristics relating to the vehicles.

Using a network of sensors as described herein may overcome problems associated with retrofitting a vehicle tracking system in an existing transportation system (e.g., existing subway or train systems). For example, in an existing subway system in which no network infrastructure exists inside tunnels, providing location signals to a central vehicle tracking system requires a wireless network. Existing subway trains may not have the technical means to transfer their position data in real time. Additionally, based on the cost of providing electrical power into the tunnels to power, any viable system must be able to provide its own power or use existing power systems, e.g., on a moving train. Embodiments disclosed herein solve these problems by measuring data on localization of the trains inside tunnels using tag sensors mounted on the trains, and transmitting the collected data wirelessly towards both tunnels entrances/ends where the data can enter the existing subway network infrastructure available on subway stations (e.g., using a backhaul network of anchor sensors). Transmitting data to both tunnels ends may also introduce redundancy and increase reliability.

FIG. 1A illustrates an example system for enhanced location and data collection from vehicles traveling along a vehicle pathway. As illustrated, in some examples, the vehicle may be a train and the vehicle pathway may be a subway tunnel system. However, other example vehicles and vehicle pathways may employ the same system as would be understood by a person of ordinary skill in the art. As illustrated, the system may calculate distance ranging from a first vehicle tagging device, e.g., on a Southbound train on Track 3. As illustrated, anchored transceivers A9, A10, A11 and A12 may all be in communications range of the first vehicle tagging device and may transmit their relative distances (e.g. from an arbitrary origin) and/or time-of-transmission to the first vehicle tagging device. The first vehicle tagging device may calculate its geolocation with high accuracy by determining intersecting distances between anchored transceivers within range and using a triangulation algorithm.

Figure 1D:
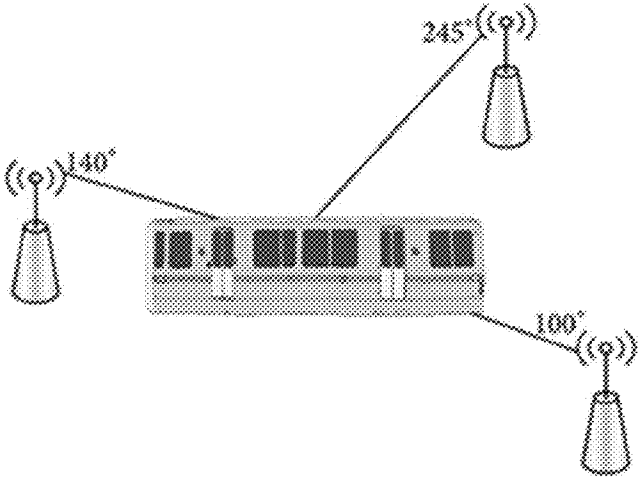
FIGS. 1B-1D illustrate example methods for enhanced location tracking consistent with embodiments disclosed herein.
Figure 1B:
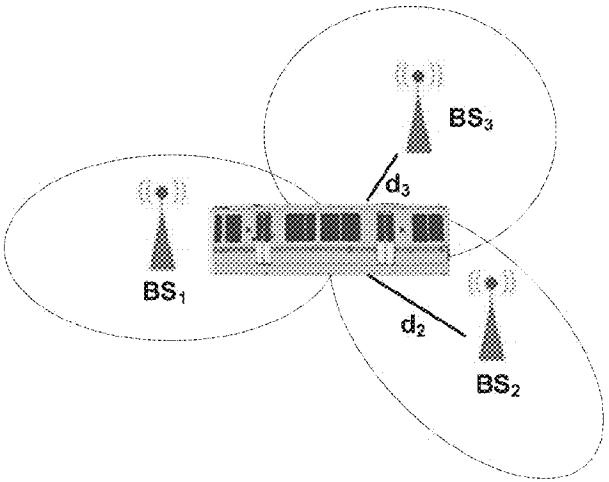
Figure 1C:
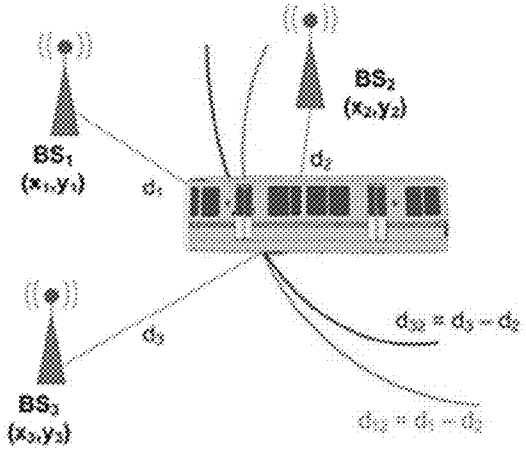

FIGS. 1B-1D illustrate example methods for enhance location tracking consistent with embodiments disclosed herein. For example, FIG. 1B illustrates a Time of Arrival (TOA) method in which a tagging device is located at intersection of three circles centered at three readers (base stations, BS); this method is called triangulation. FIG. 1C illustrates a Time Difference of Arrival (TDOA) method in which a tag device is located at intersection of three hyperbolas for which foci are the readers; this method is called trilateration. FIG. 1D illustrates a Direction of Arrival (DOA) method in which a tag device is at intersection of three rays launched from three readers. There are many technical options available for implementing the enhanced location tracking methods illustrated in FIGS. 1B-1D.

In some examples, an enhanced localization system may implement an Ultra-Wideband (UWB) localization methodology. For exam, location tracking may be based on interaction between anchors and active tags. In some examples, time-domain UWB (TD-UWB) or software defined radio (SDR) UWB (SDR-UWB) may be used. TD-UWB may provide multiple spectra instantaneously while SDR-UWB may provide an equivalent spectrum using several sequential signal transmissions. In either methodology, time-of-arrival (TOA) and/or time-of-flight (TOF) may be measured between anchor and tag devices. Measurements of TOA using TD-UWB may be performed using, for example, the 802.15.4 range measurement protocol. Measurements of TOA using SDR-UWB may be performed using Multi-Carrier (MC) UWB (MC-UWB) and other algorithms. The whole operational cycle for transmitting, receiving and processing such TOA signals could be comparable for both TD-UWB and SDR-UWB options. To reduce power consumption, anchors may be mounted in stationary positions on the walls and/or ceiling of stationary structures (e.g., subway tunnels) and tag devices may be mounted on vehicles (e.g., train cars, the train side walls, or roofs). In some examples, readers may be installed on the vehicle walls or roofs with tag devices installed on stationary structures. Geolocation data may be transferred to both ends of the stationary structures (e.g., subway tunnels) to make them available to RCC through the network gateways available in the stations. In some examples, anchor and/or tag devices may be powered by small batteries. The batteries may be made permanently chargeable from suitable energy harvesting devices. The difference between consumed power and power obtained from harvesting may be made small or close to zero to extend battery lives.

In some example, an enhanced location tracking system may implement reader devices and passive or active tag devices. For example, passive tag devices may include RFID tags.

In some examples, two or more transceivers may be implemented on tagging devices to communicate with a UHF RFID reader. Location estimation may implement techniques such as Received Signal Strength Indicator (RSSI), Time of Arrival (TOA), Time Difference of Arrival (TDOA), and fingerprint methods, as described herein.

For TOA localization, a tagging device may be visible simultaneously to several readers. Localization capabilities of tagging devices can be further improved by implementing "trajectory" tracking algorithms, e.g., car coordinates will be derived not just from a single observation but from a set of consecutive measurements and predicted in a processor. Machine learning algorithms (e.g., Gaussian process regression with interpolation/extrapolation, etc.) may also be implemented to improve accuracy.

TD-UWB chips configured to operate as readers may communicate to each other to exchange the TOA data needs to be processed for geolocation. Because no network infrastructure is available inside the subway tunnels the system must provide networking functionality in tunnels. For low-power low-rate data exchange as expected for tag geolocation data, the 915 MHz band may provide a suitable option. Because TD-UWB chip based readers do not support this communication protocol an additional transceiver may be used to enable 915 MHz wireless networking.

SDR-UWB geolocation has many similar features to the TD-UWB geolocation described above. The main difference lies in implementation. TD-UWB generates pulsed signals of instantaneous wide spectrum. SDR-UWB can produces wide spectra through frequency-stepping by generating one-by-one several/many CW tones or a sequence of a few baseband signals. In SDR-UWB such received signal components are processed to "synthesize" equivalent time-domain UWB signals. A typical SDR can form digital baseband signals up to 50-60 MHz instantaneous bandwidth with several hundreds MHz clocks. Overall time-budget for full transmission-reception-processing cycles of UWB signals in TD-UWB and SDR-UWB can be comparable because time-domain reception is not performed in true real-time in TD-UWB but through sequential sampling. SDR-UWB waveforms can be updated at a rate of 10-20 μs. A hundred of such produced spectral components would be sufficient to "synthesize" arbitrary UWB pulse at time budget of a few ms to enable 100 Hz refresh rate for SDR-UWB geolocation.

In SDR-UWB, wider signal bandwidth requires more power supply while narrower signal bandwidth require less power supply. Certain minimal UWB signal bandwidths would be required to provide major system functionality such as (1) good range resolution and precision, (2) multipath spread mitigation and others. Such bandwidth will be assessed first in simulations and then verified in hardware tests.

In SDR-UWB, one way tag-reader communication protocol, which is power saving, can be implemented using multi-carrier (MC) UWB (MC-UWB) positioning methods. MC-UWB uses transmission of several (many) sub-carriers with equalized (zeroed) initial phases. When such a signal is received, its FFT is performed and phases of all dominated spectral components will be measured and processed to estimate TOA. Multi-access (multi-tag) coding can be provided by setting weighting particular sub-carriers components (binary weights 0/1 or a few bit weighting).

In typical TD-UWB chip, at least a half of power is consumed by clocks which are permanently running while SDR-UWB could be set to operate with less power demands. Also, SDR-UWB tunable narrowband receivers could be more sensitive compared to sampler-based TD-UWB receivers. Finally, SDR-UWB based radios should have better RF power budget than TD-UWB radios.

Importantly, UWB-SDR as a reprogrammable radio can be set for networking in addition to its geolocation operational functions. In particular, SDR supports 915 MHz communication. A typical SDR chip has several Tx/Rx antenna terminals, implementing at least 2×2 MIMO scheme. Thus, one pair of Tx and Rx antenna terminals can be used to support geolocation and second pair of the Tx and Rx terminals can be used to operate the 915 MHz networking as sketched below for a generic 2×2 Tx/Rx MIMO SDR chip.

Additional ad-hoc wireless networking is required to transfer all tag positioning data to dedicated external users. This can be if all geolocation measurements can be transferred to the tunnel ends where they can enter the existing subway network available on subway stations. For this the same 915 MHz frequency or UWB mesh are options. This can be achieved by installing along tunnels set of a distributed repeaters or store-and-forward functionality.

In some examples, a network mesh of UWB nodes may be connected by firmware to create a mesh and communicate the tagging device position data to the previous and next station gateways simultaneously.

Some embodiments may incorporate SDR-UWB geolocation. Whereas TD-UWB generates pulsed signals of instantaneous wide spectrum, SDR-UWB may produce wide spectra through frequency-stepping by generating one-by-one several/many CW tones or a sequence of a few baseband signals. In SDR-UWB such received signal components may be processed to "synthesize" an equivalent time-domain UWB signals. SDR may form digital baseband signals up to 50-60 MHz instantaneous bandwidth with several hundreds MHz clocks. Overall time-budget for full transmission-reception-processing cycles of UWB signals in TD-UWB and SDR-UWB may be comparable because time-domain reception is not performed in true real-time in TD-UWB but through sequential sampling. SDR-UWB waveforms may be updated at a rate of 10-20 μs. A hundred of such produced spectral components may be sufficient to "synthesize" arbitrary UWB pulse at time budget of a few ms to enable 100 Hz refresh rate for SDR-UWB geolocation.

In SDR-UWB, wider signal bandwidth may use more power while narrower signal bandwidth may use less power. One way tagging device-anchor communication protocols may be implemented to save power is using multi-carrier (MC) UWB (MC-UWB) positioning methods. MC-UWB may use transmission of several (many) sub-carriers with equalized (zeroed) initial phases. When such a signal is received, a Fast Fourier Transform may be performed and phases of all dominant spectral components may be measured and processed to estimate TOA. Multi-access (multi-tag) coding may be provided by setting weighting particular sub-carriers components (e.g., binary weights 0/1 or a few bit weighting).

In a TD-UWB chip, at least a half of power is consumed by clocks which continuously operate while SDR-UWB may be set to operate with reduced power demands. Also, SDR-UWB may include tunable narrowband receivers that could be more sensitive compared to sampler-based TD-UWB receivers. SDR-UWB based radios may have better RF power budget than TD-UWB radios.

In some examples, UWB-SDR may include a reprogrammable radio set for networking in addition to its geolocation operational functions. In particular, SDR supports 915 MHz communication. An SDR chip may include several Tx/Rx antenna terminals, implementing at least a 2×2 MIMO scheme. Thus, one pair of Tx and Rx antenna terminals may be used to support geolocation and a second pair of the Tx and Rx terminals may be used to operate the 915 MHz networking as sketched below for a generic 2×2 Tx/Rx MIMO SDR chip.

Figure 1E:
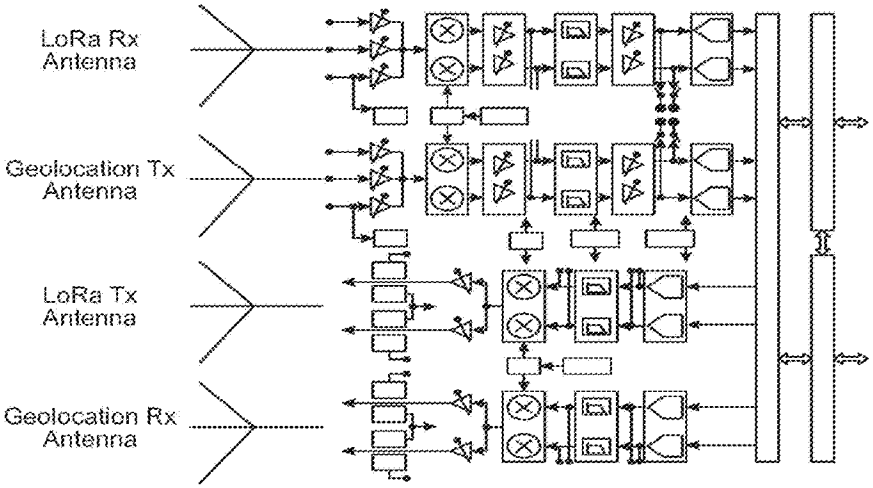
FIGS. 1E-1F illustrate example transceiver devices that may be implemented in an enhanced location tracking system consistent with embodiments disclosed herein.
Figure 1F:
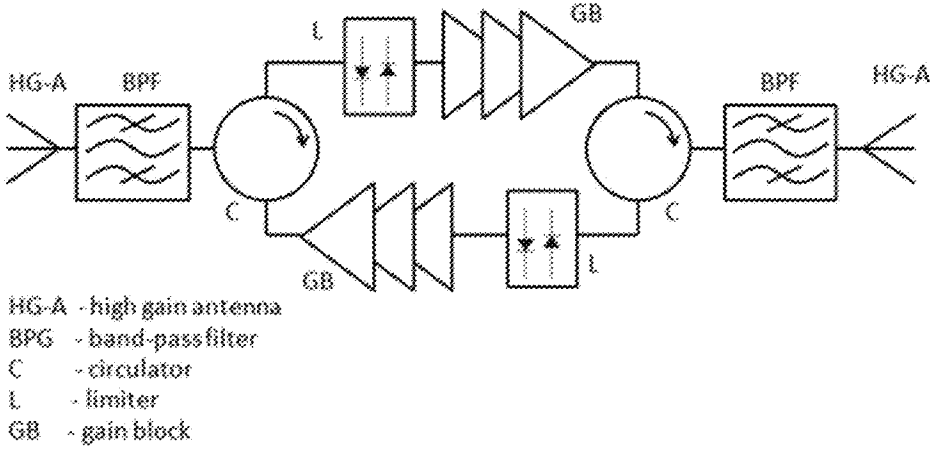

FIGS. 1E-1F illustrate example transceiver devices that may be implemented in an enhanced location tracking system. For example, FIG. 1E illustrates an example 2×2 Tx/Rx SDR layout to enable both geolocation and 915 MHz operations. Both geolocation and networking operational functions may use different types of antennas connected to their respective Tx/Rx terminals. Antennae may be omnidirectional, 180-deg, high gain, circular arrays, or other antennae as known in the art.

A system for enhanced location tracking may implement different example communication modes. For example, a TOA data communication exchange between all readers involved in geolocation of the same tagging device may be implemented to combine individual TOA measurement for tag geolocation. In some examples, communication between readers and in-tunnel network nodes to gather the computed tag geolocation data may be implemented. In some examples, communication inside an in-tunnel network may be used to transfer the computed geolocation data to both tunnel ends/entrances to make them available through the in-station subway network gateways.

In some examples, 915 MHz frequency low-power wireless networks may be implemented by the system. In other examples, Bluetooth, ZigBee, Wi-Fi, or cellular, may be used. FIG. 1F illustrates an example communications module consistent with embodiments disclosed herein.

In some examples, a UHF/UWB hybrid radio with asymmetric wireless links may be implemented as an anchor and/or a tagging device. In the downlink (reader-tag), similar to a conventional passive backscattering RFID, a transmission protocol at UHF may be adopted to control and power-up the tagging device. In the uplink (tag-reader), the energy scavenged from the UHF CW accommodates an IR-UWB transmitter to send data for a short time duration at a high data rate.

A real-time locating system (RTLS) solution may be implemented. Operating at low frequencies, e.g., within the AM broadcast band (530-1710 kHz), NFER systems may exploit the near-field behavior of radio signals within ~one-third of a wavelength. If close to a small antenna, the electric and magnetic components of radio waves are ninety degrees out of phase. Far from a small transmit antenna, these components converge to be in phase. By separately detecting, measuring, and comparing the electric and magnetic phases, distance measurements may be obtained.

Figure 2:
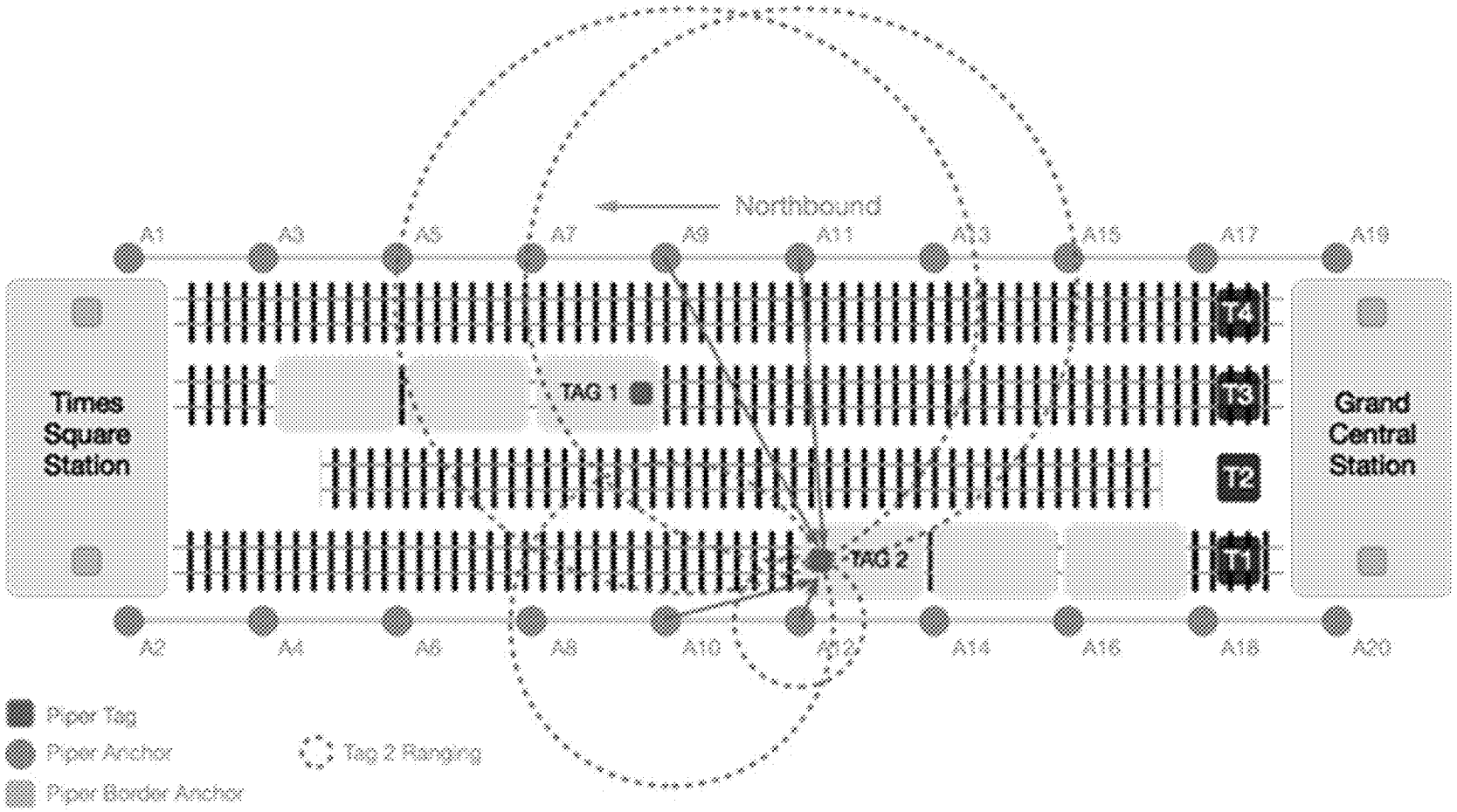
FIG. 2 illustrates an example system for enhanced location and data collection from vehicles traveling along a vehicle pathway, consistent with embodiments disclosed herein.

Some example systems may implement LIDAR to provide distance to a target by illuminating that target with a pulsed laser light, and measuring the reflected pulses with a sensor. Some example systems may implement Millimeter-wave (MW) radar FIG. 2 illustrates another embodiment of the example illustrated by FIG. 1. As illustrated in FIG. 2, the system may calculate distance ranging for a second vehicle tagging device on a Northbound train on Track 1. As illustrated, anchored transceiver devices A9, A10, A11 and A12 may be in range with the second vehicle tagging device and may transmit their relative distances to the second vehicle tagging device. The second vehicle tagging device may calculate its position with high accuracy by identifying intersecting distances between anchored transceivers within its range and applying a triangulation algorithm.

In some examples of the embodiment illustrated by FIGS. 1A and 2, anchored transceivers in a first wall adjacent to the vehicle pathway (e.g., a West wall, as illustrated) may forward packets along a corresponding backhaul (e.g., Northbound), and anchored transceivers along a second wall adjacent to the vehicle pathway and opposite the first wall (e.g., an East wall, as illustrated) may forward packets along a corresponding backhaul (e.g., Southbound). When a vehicle tagging device has calculated its position, it may inject (e.g., transmit) its location into the backhaul by sending data to the farthest anchored transceiver it can reach (e.g., which is still in range) in the direction that the train is heading, and the nearest anchored transceiver (n+/−1) it can reach in the opposite direction. The receiving anchored transceivers forwards the location data to the farthest anchored transceivers they can reach, respectively. This forwarding process may be repeated iteratively until the location data reaches the base stations (e.g., border anchored transceivers). The location data may then be transmitted to a centralized enhanced transit location system (ETLS). In some examples, the ETLS may be a cloud-based computer server or network of computer servers.

Figure 3:
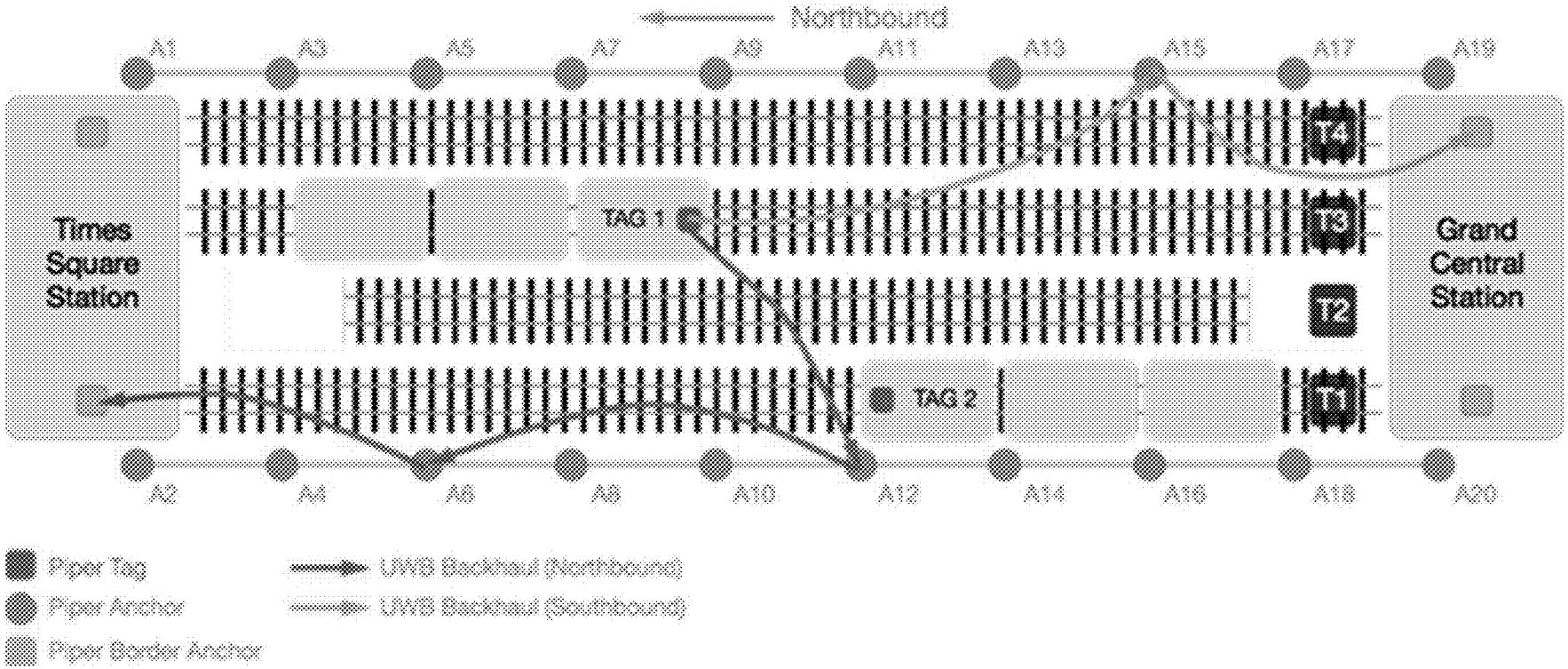
FIG. 3 illustrates an example system for enhanced location and data collection from vehicles traveling along a vehicle pathway, consistent with embodiments disclosed herein.
Figure 4A:
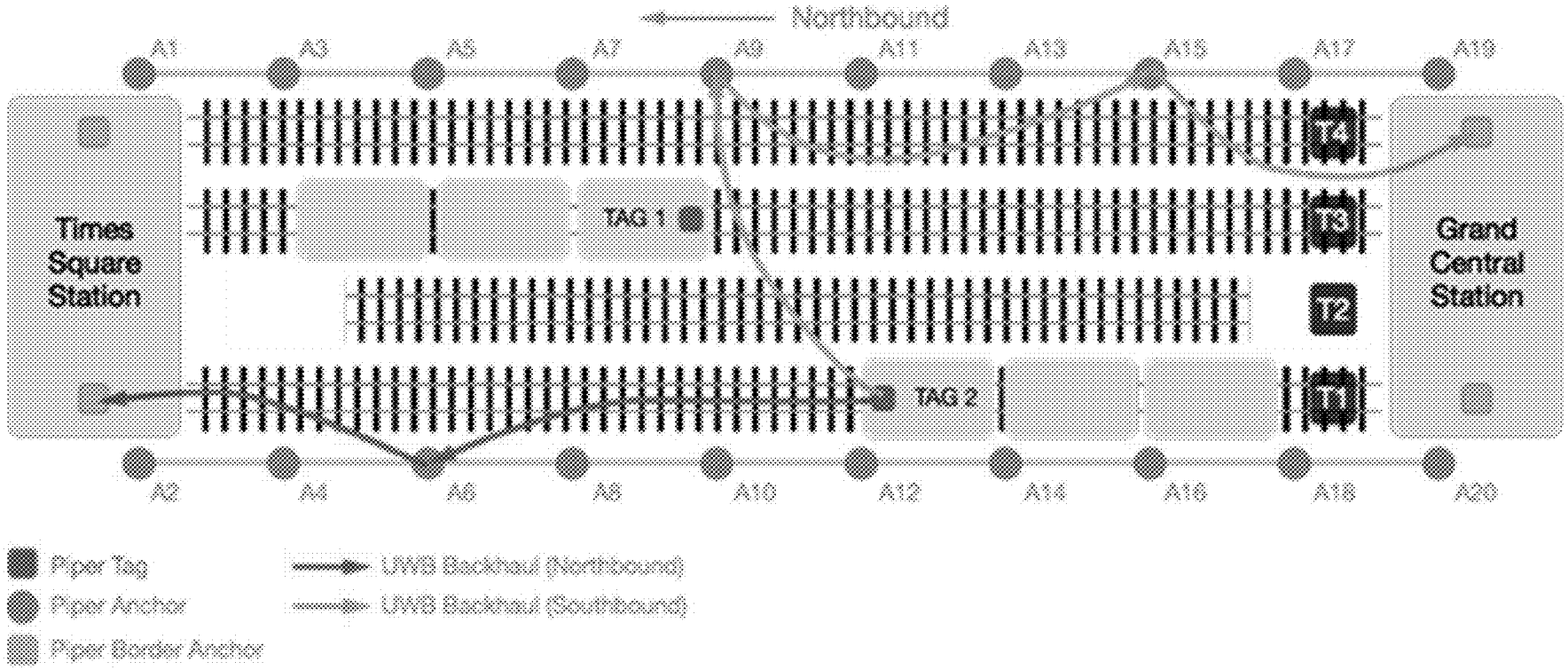
FIG. 4A illustrates an example system enhanced location and data collection from vehicles traveling along a vehicle pathway, consistent with embodiments disclosed herein.

Consistent with the embodiment illustrated by FIGS. 1A and 2, FIG. 3 illustrates a location data signal being propagated along multiple backhauls from the first vehicle tagging device and FIG. 4A illustrates a location data signal being propagated along multiple backhauls from the second vehicle tagging device. In some embodiments, a location data signal may be propagated in both directions by one or both backhauls.

Figure 4B:
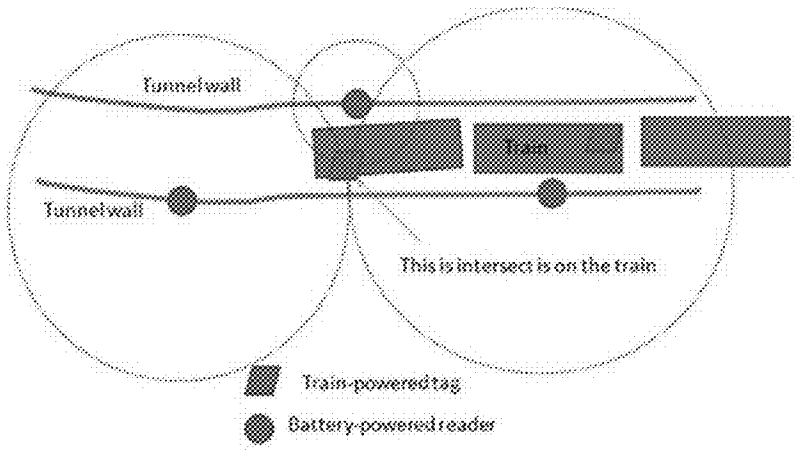
FIGS. 4B-4E illustrate example spatial anchor-tag device layouts, consistent with embodiments disclosed herein.
Figure 4C:
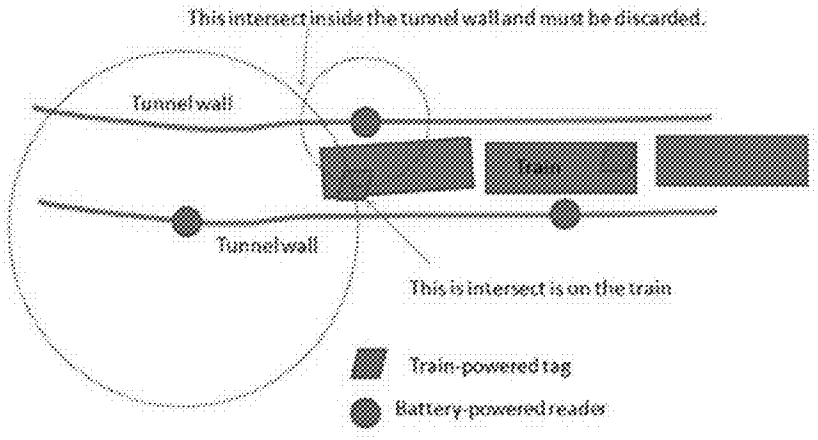
Figure 4D:
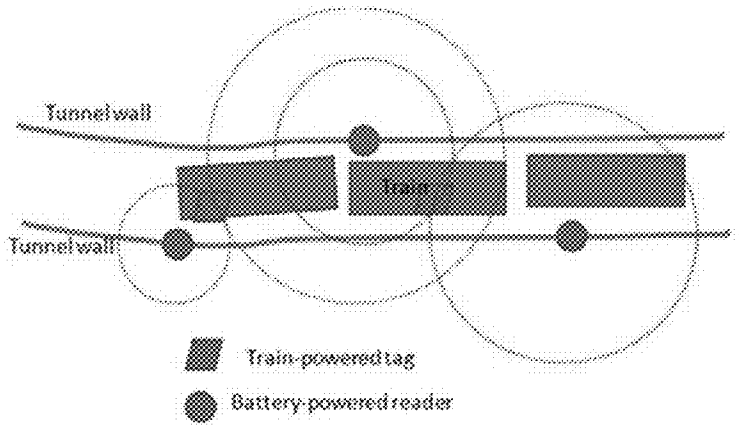
Figure 4E:
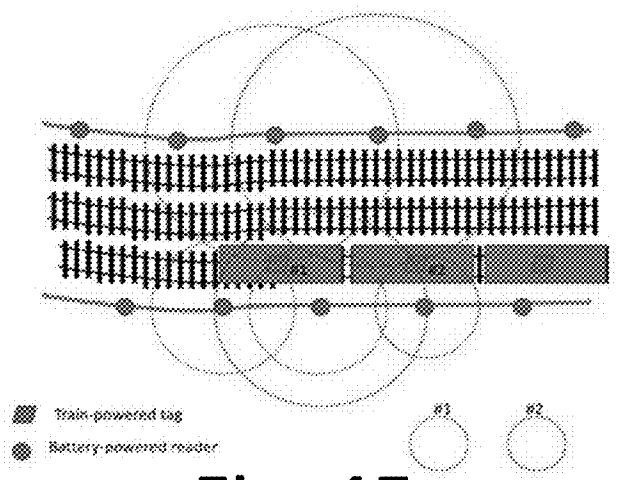

FIGS. 4B, 4C, and 4D illustrate example spatial anchor-tag device layouts. For example, FIG. 4B illustrates an example configuration implementing readers on both tunnel side walls to locate a tag on cars' roofs. In another example illustrated by FIG. 4C, readers on opposite tunnel side walls locate one tag on cars' roofs. In another example illustrated in FIG. 4D, readers on both tunnel side walls locate two tags on cars' roofs. FIG. 4E—illustrate a multi-track configuration. In such configurations, using multiple anchors to introduce redundancy may improve accuracy.

In some examples, the ETLS backhaul may include an auto-healing chained mesh. Each backhaul packet may be acknowledged by the receiving anchored transceiver (n). In the event that an anchored transceiver n fails to acknowledge a packet for any reason, the transmitting anchoring transceiver (x) may attempt to reforward the packet to an alternate receiving anchoring receiver (n-1). To optimize this process, backhaul anchoring transceivers may be weighted as a function of their reliability to successfully forward packets, such that the most reliable path is used for any given environment.

The anchored transceivers may calculate and transmit relative distance to an approaching vehicle tagging device as well as transmit location data through the backhaul to bridge anchoring transceivers.

In some examples, an anchored transceiver may include one or more UWB radios operating across multiple channels (e.g., between 3 and 12 channels). In some examples, the radios may operate in a range between 3.5 GHz and 6.5 GHz. Example anchored transceivers may include a high gain bi-directional antenna, a low gain hemispherical antenna, a Bluetooth low-energy 2.4 Ghz radio for device provisioning, an ultra-low power microcontroller, controller buttons or switches, a battery pack, and/or a DC power input for energy harvesting device or external power supply. In some examples, energy harvesting may be accomplished using wind generated by moving trains, ambient heat, solar power, induction, or other energy harvesting means as known in the art. Anchored transceivers may be securely provisioned over BLE.

In some examples, vehicle tagging devices may be mounted on an external surface of a vehicle. In the example of a subway train, vehicle tagging devices may be affixed to the front and/or rear of individual train cars. Vehicle tagging devices may obtain ranging and distance data, e.g., as provided in data signals transmitted from anchored transceivers along the vehicle pathway. The vehicle tagging device may transmit a ping. The anchored transceivers may respond to the ping with a corresponding anchor identification signal. In some examples, the anchored transceivers may also transmit a relative distance from the vehicle tagging device that transmitted the initial ping. The vehicle tagging device may calculate real-time multilateration and inject location data into the backhaul.

In some embodiments, a vehicle tagging device may include one or more UWB radios operating across multiple channels (e.g., between 3 and 12 channels). In some examples, the radios may operate in a range between 3.5 GHz and 6.5 GHz. Example vehicle tagging devices may include a high gain bi-directional antenna, a low gain hemispherical antenna, a Bluetooth low-energy 2.4 Ghz radio for device provisioning, an ultra-low power microcontroller, controller buttons or switches, a battery pack, and/or a DC power input for energy harvesting device or external power supply. Example vehicle tagging devices may also include a micro-computer (e.g., a Linux based 1 GHz SBC, or other microcomputer as known in the art). Example vehicle tagging devices may also include a power input port (e.g., a micro-USB DC power input, or other power supply port as known in the art). A vehicle tagging device may be securely provisioned over BLE with a unique vehicle identification.

In some embodiments, the vehicle tagging devices may include two transceivers, e.g., UWB radios. The transceivers may be positioned to transmit and receive data in opposite directions, such that a first transceiver may obtain vehicle ranging data in coordination with the anchor devices, and a second transceiver may transmit and receive location data down the backhaul. By mounting a tagging device on each side of a vehicle (e.g., a front of a train and a back of a train), a front-facing tagging device may use a front facing transceiver to obtain ranging data and use a back facing transceiver to transmit the ranging data to an onboard computer and the rear-facing tagging device. The rear-facing tagging device may use its rear facing transceiver to transmit location data down the backhaul.

A bridge anchoring transceiver may serve as an Internet gateways to the UWB backhaul. Example bridge anchoring transceivers may transmit vehicle location data to an ETLS Cloud. Bridge anchoring transceivers may be installed at access points to the vehicle pathway, such as ingress and egress points for train tunnels. The bridge anchoring transceivers may be communicatively coupled to the Internet via wired or wireless networking technology.

In some embodiments, a bridge anchoring transceiver may include one or more UWB radios operating across multiple channels (e.g., between 3 and 12 channels). In some examples, the radios may operate in a range between 3.5 GHz and 6.5 GHz. Example vehicle tagging devices may include a high gain bi-directional antenna, a low gain hemispherical antenna, a Bluetooth low-energy 2.4 Ghz radio for device provisioning, an ultra-low power microcontroller, controller buttons or switches, a battery pack, and/or a DC power input for energy harvesting device or external power supply. Example bridge anchoring transceivers may also include a micro-computer and a power input port (e.g., Power-Over-Ethernet). Example bridge anchoring transceivers may also include an energy harvesting device.

In some embodiments, an ETLS Cloud may aggregate vehicle location data from bridge anchoring transceivers and provide a real-time user interface, e.g., using a graphical user interface as disclosed herein.

Some embodiments of the disclosure provide a method for improving accuracy of an enhanced transit location system. A method for improving accuracy of an enhanced transit location system may include coupling a digital image sensor (e.g., a digital camera) to a Vehicle tagging device and positioning the digital image sensor longitudinally along the travel axis of the vehicle so as to capture image data in front of or behind the vehicle as it moves. Survey markers may be provided along the travel path of the vehicle (e.g., a train track or a road), within the field of view of the digital image sensor. The method may include obtaining image data from the digital image sensor while the vehicle is in motion, identifying the vehicle position at any given time based on visual queue captured in the image data from the survey markers, and verifying the vehicle position identified from the Vehicle tagging devices and Anchored transceivers using the vehicle position identified from the image data.

Some embodiments of the disclosure provide an ETLS Provisioning App. For example, to facilitate provisioning, installation, and testing of the Piper ETLS system, a mobile device application may be deployed on a smartphone (e.g., a ruggedized smartphone) and distributed to personnel responsible for installing and testing the UWB equipment in the field. The ETLS Provisioning App may be communicatively coupled to anchored transceivers using a secure wireless connection, e.g., Bluetooth or WiFi. Anchored transceivers may communicate with nearby anchored transceivers within range to communicate current location for one or more vehicle tagging devices and a proximate survey marker in order to reduce provisioning time for anchored transceivers. A list of survey markers may be stored in a database located in the ETLS Cloud and synchronized with the ETLS Provisioning App when the provisioning App is connected to the network. In addition to provisioning, the ETLS Provisioning App may include a ranging feature for testing the overall health of the UWB backhaul.

Figures 5A, 5B, 5C:
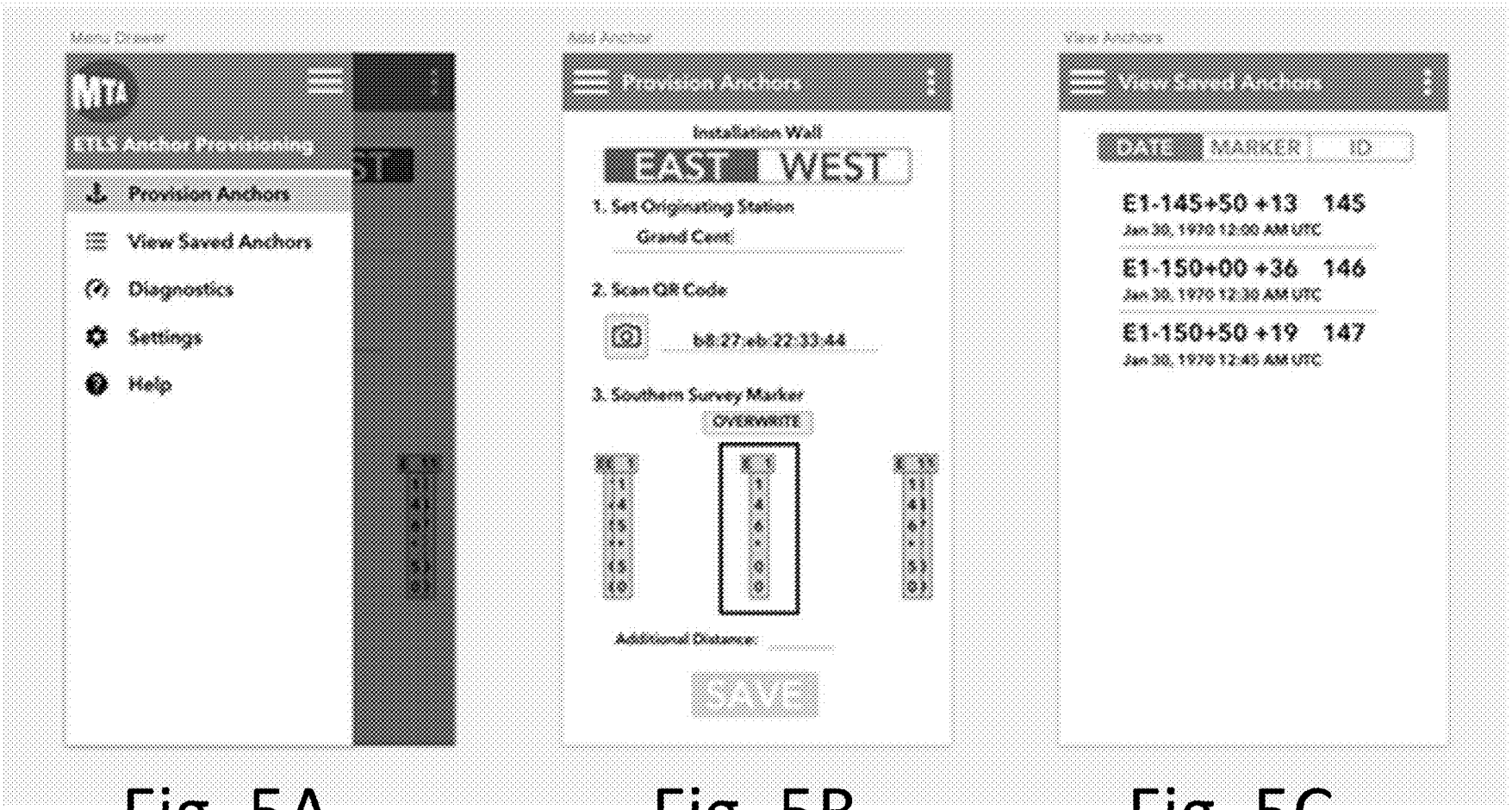
FIG. 5A illustrates an example graphical user interface for an app for communicating and interacting with a system for enhanced location and data collection from vehicles traveling along a vehicle pathway, consistent with embodiments disclosed herein.
FIG. 5B illustrates an example graphical user interface for an app for communicating and interacting with a system for enhanced location tracking, consistent with embodiments disclosed herein.
FIG. 5C illustrates an example graphical user interface for an app for communicating and interacting with a system for enhanced location and data collection from vehicles traveling along a vehicle pathway, consistent with embodiments disclosed herein.

FIGS. 5A-5C are screenshots illustrating Anchored transceivers being provisioned based on Installation Wall, Originating Station, Anchor MAC address (scanned via QR code or manually entered) and distance from the survey marker to the south of the anchored transceiver.

Figure 6A:
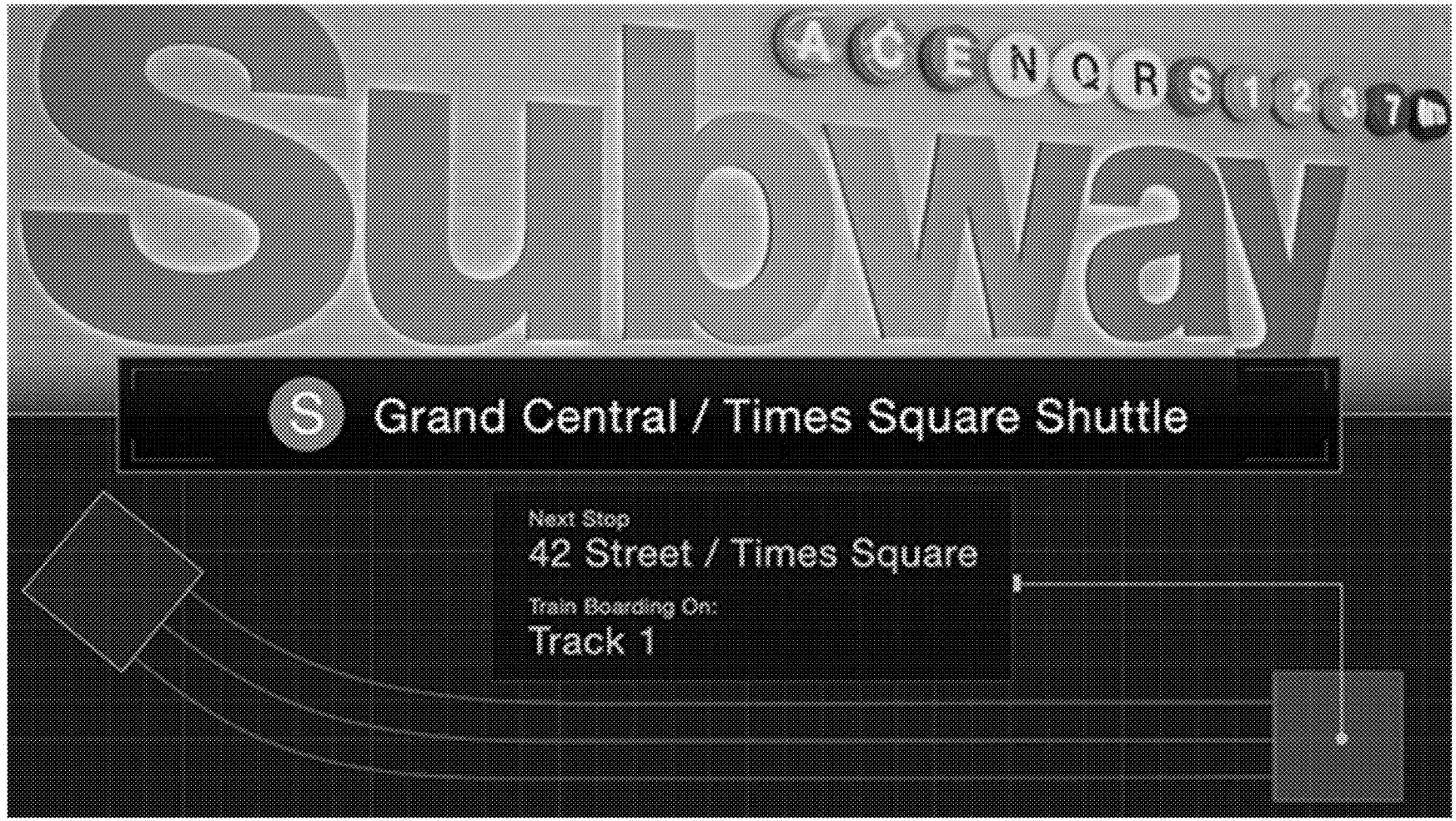
FIG. 6A illustrates an example graphical user interface for displaying data from a system for enhanced location and data collection from vehicles traveling along a vehicle pathway, consistent with embodiments disclosed herein.
Figure 6B:
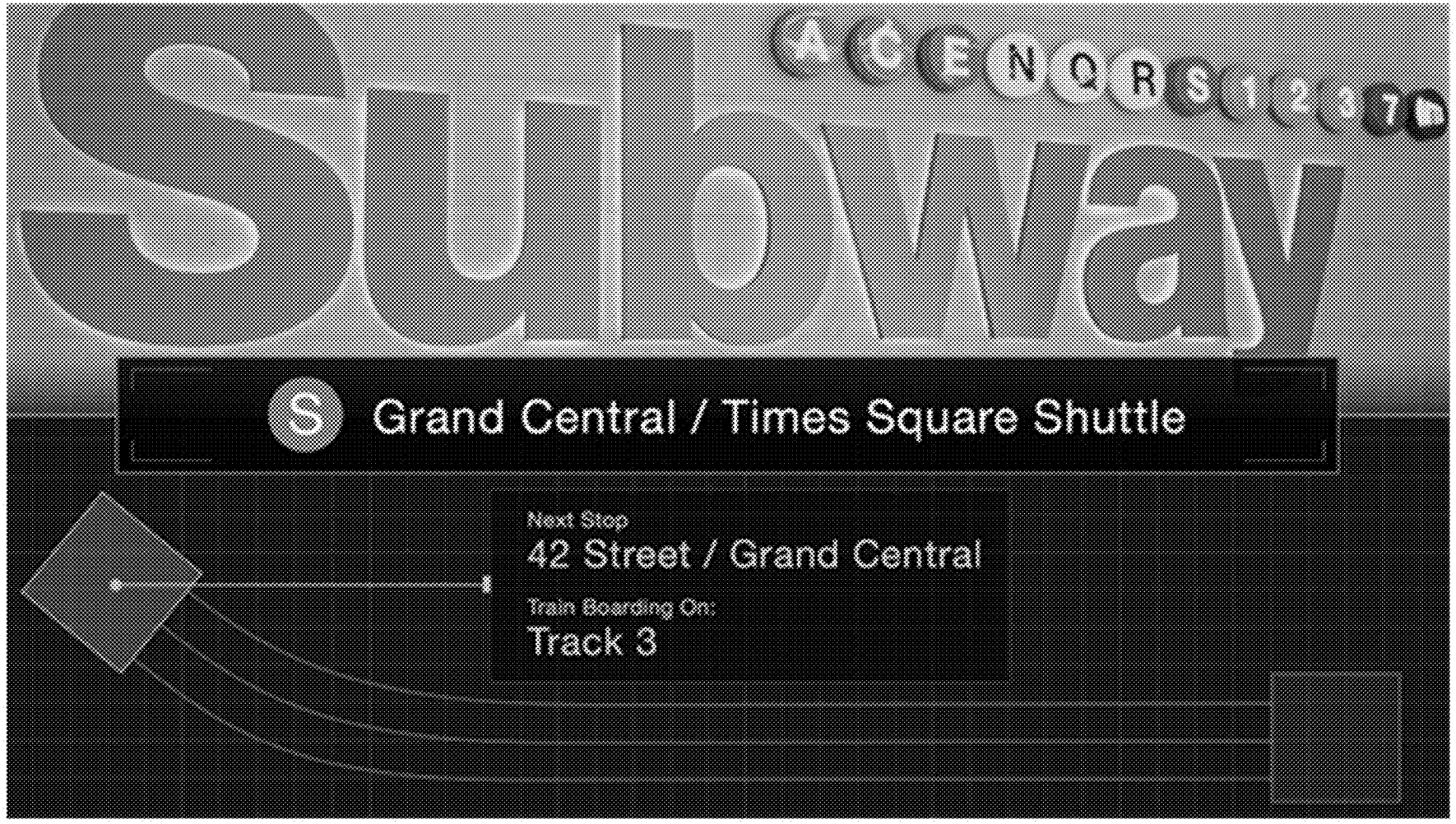
FIG. 6B illustrates an example graphical user interface for displaying data from a system for enhanced location and data collection from vehicles traveling along a vehicle pathway, consistent with embodiments disclosed herein.
Figure 6C:
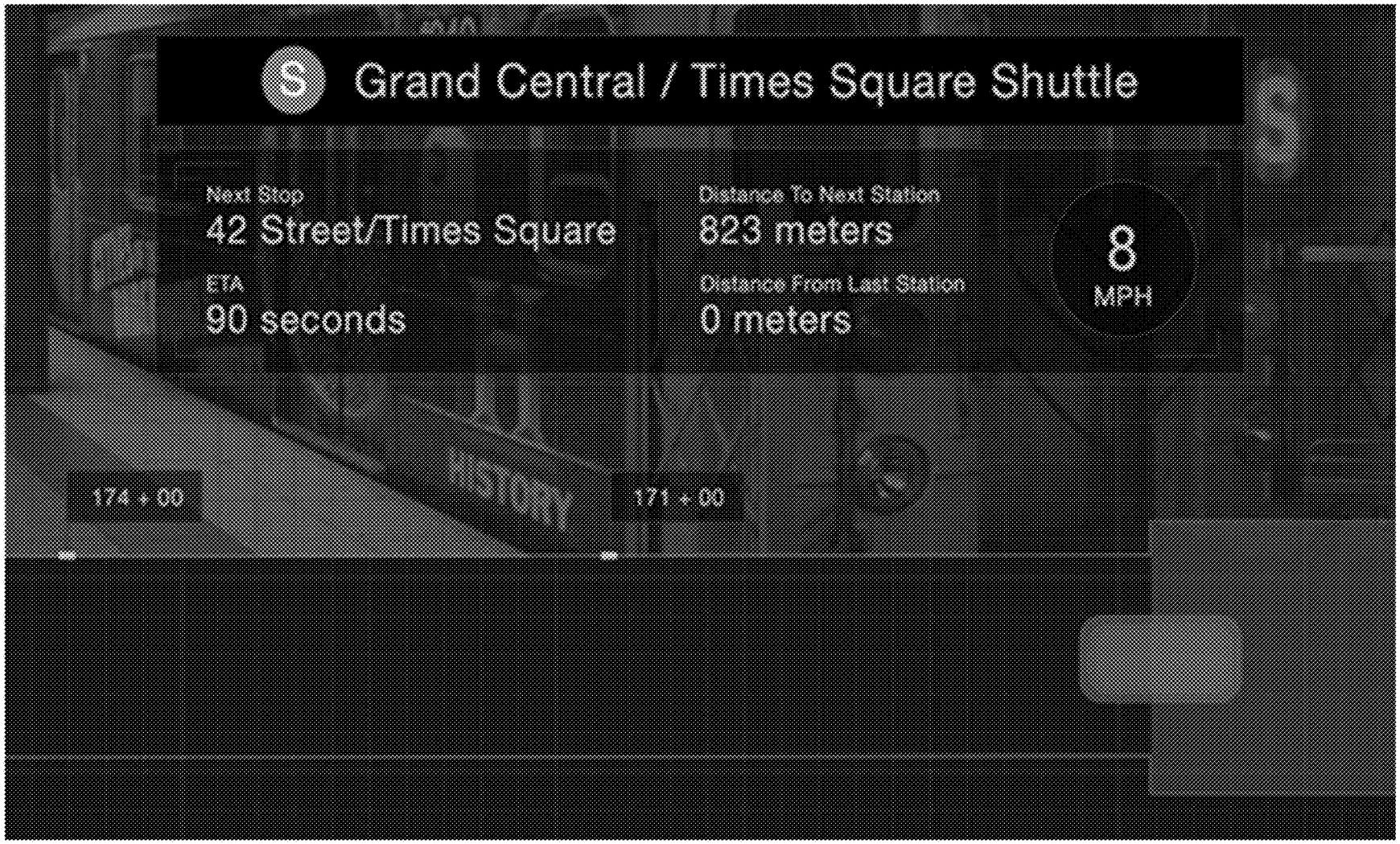
FIG. 6C illustrates an example graphical user interface for displaying data from a system for enhanced location and data collection from vehicles traveling along a vehicle pathway, consistent with embodiments disclosed herein.
Figure 6D:
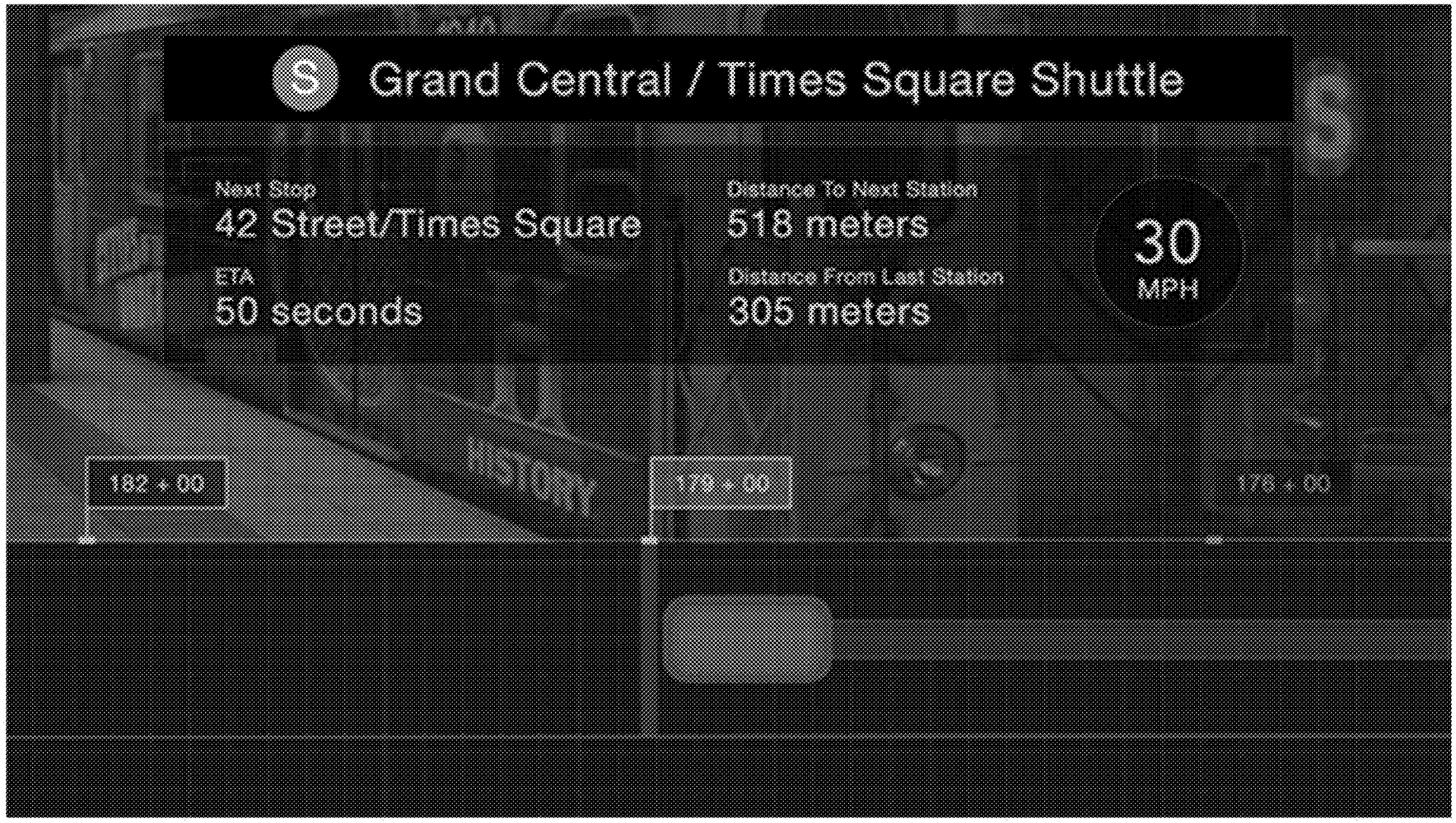
FIG. 6D illustrates an example graphical user interface for displaying data from a system for enhanced location and data collection from vehicles traveling along a vehicle pathway, consistent with embodiments disclosed herein.

FIGS. 6A-6D illustrate an example graphical user interface for displaying vehicle positioning information. FIG. 6A illustrates a graphical user interface showing a graphical view of a next station on the line is highlighted along with what track the train is departing from. FIG. 6B illustrates a graphical user interface showing a graphical view of a train track with the line highlighted along with what track the train is leaving from. FIGS. 6C and 6D illustrate a graphical user interface displaying animations of vehicle location on a line along with corresponding data received from Vehicle tagging devices and/or anchored transceivers. The user interface may display the track that a train is on with the station at the far edge of the page. In some examples, the station background image may fade out. In some examples, the train background image may fade-in. The user interface may provide a "heads up display (HUD)" to display and/or scroll data on a screen. Train moves from side of screen until it reaches the horizontal middle of the screen then it stays centered and the track then moves with Survey Markers updating based on train position in the tunnel.

In some examples, the user interface may update data displayed in real-time or semi-real-time. For example, distance along a backhaul and/or speed data for a given vehicle may be updated regularly within the user interface.

As will be appreciated, the method as described herein may be performed using a computing system having machine executable instructions stored on a tangible medium. The instructions are executable to perform each portion of the method, either autonomously, or with the assistance of input from an operator.

Those skilled in the art will appreciate that the disclosed embodiments described herein are by way of example only, and that numerous variations will exist. The invention is limited only by the claims, which encompass the embodiments described herein as well as variants apparent to those skilled in the art. In addition, it should be appreciated that structural features or method steps shown or described in any one embodiment herein can be used in other embodiments as well.

As used herein, the terms logical circuit and component might describe a given unit of functionality that can be performed in accordance with one or more embodiments of the technology disclosed herein. As used herein, either a logical circuit or a component might be implemented utilizing any form of hardware, software, or a combination thereof. For example, one or more processors, controllers, ASICs, PLAs, PALs, CPLDs, FPGAs, logical components, software routines or other mechanisms might be implemented to make up a component. In implementation, the various components described herein might be implemented as discrete components or the functions and features described can be shared in part or in total among one or more components. In other words, as would be apparent to one of ordinary skill in the art after reading this description, the various features and functionality described herein may be implemented in any given application and can be implemented in one or more separate or shared components in various combinations and permutations. Even though various features or elements of functionality may be individually described or claimed as separate components, one of ordinary skill in the art will understand that these features and functionality can be shared among one or more common software and hardware elements, and such description shall not require or imply that separate hardware or software components are used to implement such features or functionality.

Where components, logical circuits, or components of the technology are implemented in whole or in part using software, in one embodiment, these software elements can be implemented to operate with a computing or logical circuit capable of carrying out the functionality described with respect thereto. Various embodiments are described in terms of this example logical circuit 1100. After reading this description, it will become apparent to a person skilled in the relevant art how to implement the technology using other logical circuits or architectures.

Figure 7:
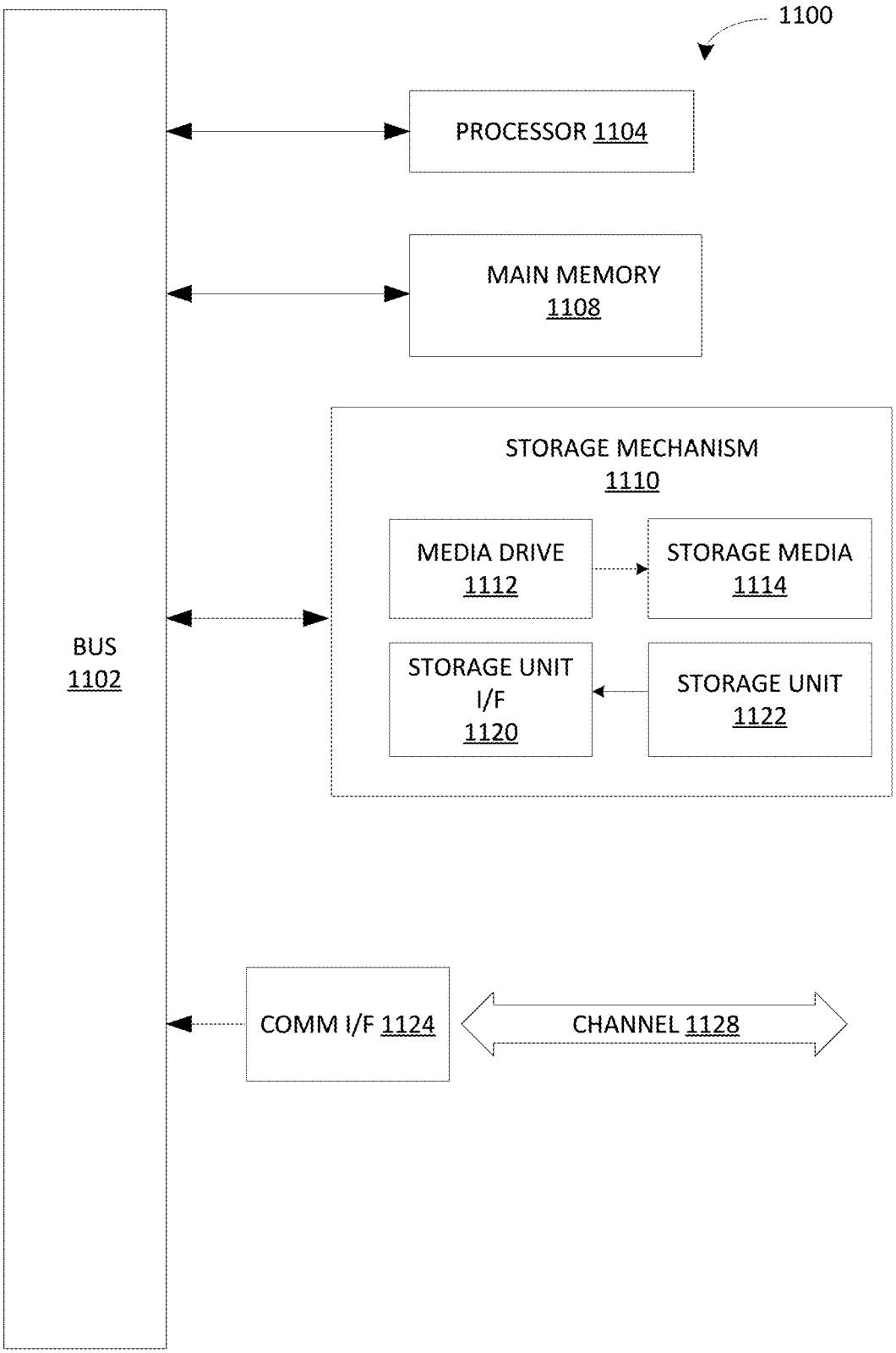
FIG. 7 illustrates an example computing system that may be used in implementing various features of embodiments of the disclosed technology.

Referring now to FIG. 7, computing system 1100 may represent, for example, computing or processing capabilities found within desktop, laptop and notebook computers; hand-held computing devices (PDA's, smart phones, cell phones, palmtops, etc.); mainframes, supercomputers, workstations or servers; or any other type of special-purpose or general-purpose computing devices as may be desirable or appropriate for a given application or environment. Logical circuit 1100 might also represent computing capabilities embedded within or otherwise available to a given device. For example, a logical circuit might be found in other electronic devices such as, for example, digital cameras, navigation systems, cellular telephones, portable computing devices, modems, routers, WAPs, terminals and other electronic devices that might include some form of processing capability.

Computing system 1100 might include, for example, one or more processors, controllers, control components, or other processing devices, such as a processor 1104. Processor 1104 might be implemented using a general-purpose or special-purpose processing component such as, for example, a microprocessor, controller, or other control logic. In the illustrated example, processor 1104 is connected to a bus 1102, although any communication medium can be used to facilitate interaction with other components of logical circuit 1100 or to communicate externally.

Computing system 1100 might also include one or more memory components, simply referred to herein as main memory 1108. For example, preferably random access memory (RAM) or other dynamic memory, might be used for storing information and instructions to be executed by processor 1104. Main memory 1108 might also be used for storing temporary variables or other intermediate information during execution of instructions to be executed by processor 1104. Logical circuit 1100 might likewise include a read only memory ("ROM") or other static storage device coupled to bus 1102 for storing static information and instructions for processor 1104.

The computing system 1100 might also include one or more various forms of information storage mechanism 1110, which might include, for example, a media drive 1112 and a storage unit interface 1120. The media drive 1112 might include a drive or other mechanism to support fixed or removable storage media 1114. For example, a hard disk drive, a floppy disk drive, a magnetic tape drive, an optical disk drive, a CD or DVD drive (R or RW), or other removable or fixed media drive might be provided. Accordingly, storage media 1114 might include, for example, a hard disk, a floppy disk, magnetic tape, cartridge, optical disk, a CD or DVD, or other fixed or removable medium that is read by, written to or accessed by media drive 1112. As these examples illustrate, the storage media 1114 can include a computer usable storage medium having stored therein computer software or data.

In alternative embodiments, information storage mechanism 1110 might include other similar instrumentalities for allowing computer programs or other instructions or data to be loaded into logical circuit 1100. Such instrumentalities might include, for example, a fixed or removable storage unit 1122 and an interface 1120. Examples of such storage units 1122 and interfaces 1120 can include a program cartridge and cartridge interface, a removable memory (for example, a flash memory or other removable memory component) and memory slot, a PCMCIA slot and card, and other fixed or removable storage units 1122 and interfaces 1120 that allow software and data to be transferred from the storage unit 1122 to logical circuit 1100.

Logical circuit 1100 might also include a communications interface 1124. Communications interface 1124 might be used to allow software and data to be transferred between logical circuit 1100 and external devices. Examples of communications interface 1124 might include a modem or softmodem, a network interface (such as an Ethernet, network interface card, WiMedia, IEEE 802.XX or other interface), a communications port (such as for example, a USB port, IR port, RS232 port Bluetooth® interface, or other port), or other communications interface. Software and data transferred via communications interface 1124 might typically be carried on signals, which can be electronic, electromagnetic (which includes optical) or other signals capable of being exchanged by a given communications interface 1124. These signals might be provided to communications interface 1124 via a channel 1128. This channel 1128 might carry signals and might be implemented using a wired or wireless communication medium. Some examples of a channel might include a phone line, a cellular link, an RF link, an optical link, a network interface, a local or wide area network, and other wired or wireless communications channels.

In this document, the terms "computer program medium" and "computer usable medium" are used to generally refer to media such as, for example, memory 1108, storage unit 1120, media 1114, and channel 1128. These and other various forms of computer program media or computer usable media may be involved in carrying one or more sequences of one or more instructions to a processing device for execution. Such instructions embodied on the medium, are generally referred to as "computer program code" or a "computer program product" (which may be grouped in the form of computer programs or other groupings). When executed, such instructions might enable the logical circuit 1100 to perform features or functions of the disclosed technology as discussed herein.

Although FIG. 7 depicts a computer network, it is understood that the disclosure is not limited to operation with a computer network, but rather, the disclosure may be practiced in any suitable electronic device. Accordingly, the computer network depicted in FIG. 7 is for illustrative purposes only and thus is not meant to limit the disclosure in any respect.

Further details may be found in the attached appendices: Appendix A and Appendix B.

While various embodiments of the disclosed technology have been described above, it should be understood that they have been presented by way of example only, and not of limitation. Likewise, the various diagrams may depict an example architectural or other configuration for the disclosed technology, which is done to aid in understanding the features and functionality that can be included in the disclosed technology. The disclosed technology is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the technology disclosed herein. Also, a multitude of different constituent component names other than those depicted herein can be applied to the various partitions.

Additionally, with regard to flow diagrams, operational descriptions and method claims, the order in which the steps are presented herein shall not mandate that various embodiments be implemented to perform the recited functionality in the same order unless the context dictates otherwise.

Although the disclosed technology is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosed technology, whether or not such embodiments are described and whether or not such features are presented as being a part of a described embodiment. Thus, the breadth and scope of the technology disclosed herein should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "component" does not imply that the components or functionality described or claimed as part of the component are all configured in a common package. Indeed, any or all of the various components of an component, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

The invention claimed is:

1. A system, comprising:

one or more hardware processors; and a non-transitory machine-readable storage medium encoded with instructions that, when executed by the one or more hardware processors, cause the system to perform operations comprising:

transmitting, from a first electronic device of a plurality of the first electronic devices anchored along a transportation pathway, a first wireless signal, the first wireless signal identifying a location of the first electronic device along the transportation pathway, wherein a second electronic device attached to a vehicle traveling along the transportation pathway determines a location of the vehicle along the transportation pathway according to the first wireless signal;

receiving, by any one of the plurality of the first electronic devices, a second wireless signal transmitted by the second electronic device, wherein the second wireless signal identifies the location of the vehicle along the transportation pathway; and transmitting, from the any one of the plurality of the first electronic devices, a third wireless signal, wherein the third wireless signal identifies the location of the vehicle along the transportation pathway, wherein other ones of the first electronic devices wirelessly relay the third wireless signals along the transportation pathway.

2. The system of claim 1, wherein:

the first wireless signal identifies a location of the first electronic device.

3. The system of claim 2, the operations further comprising:

receiving, by any one of the plurality of the first electronic devices, prior to the first electronic device transmitting the first wireless signal, a fourth wireless signal transmitted by the second electronic device; and responsive to receiving the fourth wireless signal, transmitting, from the first electronic device, the first wireless signal.

4. The system of claim 3, the operations further comprising:

determining, at the first electronic device, based on the fourth wireless signal, a distance between the first and second electronic devices; and identifying the determined distance between the first electronic device and the second electronic device in the first wireless signal, wherein the second electronic device determines the location of the vehicle along the transportation pathway based on the location of the first electronic device and the distance between the first electronic device and the second electronic device.

5. The system of claim 1, wherein:

the transportation pathway comprises a plurality of tracks; and the second electronic device determines the track on which the vehicle is traveling according to the first wireless signal.

6. The system of claim 1, wherein:

the first, second, and third wireless signals are impulse-radio ultra-wideband (IR-UWB) signals.

7. The system of claim 1, wherein:

the first electronic device is anchored to a wall near the transportation pathway; and the second electronic device determines the location of the vehicle along the transportation pathway according to the first wireless signal and a location of the wall.

8. A non-transitory machine-readable storage medium encoded with instructions that, when executed by one or more hardware processors of a computing system, cause the computing system to perform operations comprising:

transmitting, from a first electronic device of a plurality of the first electronic devices anchored along a transportation pathway, a first wireless signal, the first wireless signal identifying a location of the first electronic device along the transportation pathway, wherein a second electronic device attached to a vehicle traveling along the transportation pathway determines a location of the vehicle along the transportation pathway according to the first wireless signal;

receiving, by any one of the plurality of the first electronic devices, a second wireless signal transmitted by the second electronic device, wherein the second wireless signal identifies the location of the vehicle along the transportation pathway; and transmitting, from the any one of the plurality of the first electronic devices, a third wireless signal, wherein the third wireless signal identifies the location of the vehicle along the transportation pathway, wherein other ones of the first electronic devices wirelessly relay the third wireless signals along the transportation pathway.

9. The non-transitory machine-readable storage medium of claim 8, wherein:

the first wireless signal identifies a location of the first electronic device.

10. The non-transitory machine-readable storage medium of claim 9, the operations further comprising:

receiving, by any one of the plurality of the first electronic devices, prior to the first electronic device transmitting the first wireless signal, a fourth wireless signal transmitted by the second electronic device; and responsive to receiving the fourth wireless signal, transmitting, from the first electronic device, the first wireless signal.

11. The non-transitory machine-readable storage medium of claim 10, the operations further comprising:

determining, at the first electronic device, based on the fourth wireless signal, a distance between the first and second electronic devices; and identifying the determined distance between the first electronic device and the second electronic device in the first wireless signal, wherein the second electronic device determines the location of the vehicle along the transportation pathway based on the location of the first electronic device and the distance between the first electronic device and the second electronic device.

12. The non-transitory machine-readable storage medium of claim 8, wherein:

the transportation pathway comprises a plurality of tracks; and the second electronic device determines the track on which the vehicle is traveling according to the first wireless signal.

13. The non-transitory machine-readable storage medium of claim 8, wherein:

the first, second, and third wireless signals are impulse-radio ultra-wideband (IR-UWB) signals.

14. The non-transitory machine-readable storage medium of claim 8, wherein:

the first electronic device is anchored to a wall near the transportation pathway; and the second electronic device determines the location of the vehicle along the transportation pathway according to the first wireless signal and a location of the wall.

15. A computer-implemented method, comprising:

transmitting, from a first electronic device of a plurality of the first electronic devices anchored along a transportation pathway, a first wireless signal, the first wireless signal identifying a location of the first electronic device along the transportation pathway, wherein a second electronic device attached to a vehicle traveling along the transportation pathway determines a location of the vehicle along the transportation pathway according to the first wireless signal;

receiving, by any one of the plurality of the first electronic devices, a second wireless signal transmitted by the second electronic device, wherein the second wireless signal identifies the location of the vehicle along the transportation pathway; and transmitting, from the any one of the plurality of the first electronic devices, a third wireless signal, wherein the third wireless signal identifies the location of the vehicle along the transportation pathway, wherein other ones of the first electronic devices wirelessly relay the third wireless signals along the transportation pathway.

16. The computer-implemented method of claim 15, wherein:

the first wireless signal identifies a location of the first electronic device.

17. The computer-implemented method of claim 16, further comprising:

receiving, by any one of the plurality of the first electronic devices, prior to the first electronic device transmitting the first wireless signal, a fourth wireless signal transmitted by the second electronic device; and responsive to receiving the fourth wireless signal, transmitting, from the first electronic device, the first wireless signal.

18. The computer-implemented method of claim 17, further comprising:

determining, at the first electronic device, based on the fourth wireless signal, a distance between the first and second electronic devices; and identifying the determined distance between the first electronic device and the second electronic device in the first wireless signal, wherein the second electronic device determines the location of the vehicle along the transportation pathway based on the location of the first electronic device and the distance between the first electronic device and the second electronic device.

19. The computer-implemented method of claim 15, wherein:

the transportation pathway comprises a plurality of tracks; and the second electronic device determines the track on which the vehicle is traveling according to the first wireless signal.

20. The computer-implemented method of claim 15, wherein:

the first, second, and third wireless signals are impulse-radio ultra-wideband (IR-UWB) signals.

* * * * *